US006209766B1

(12) United States Patent
Kwon

(10) Patent No.: US 6,209,766 B1
(45) Date of Patent: Apr. 3, 2001

(54) BELT-MOUNTED APPARATUS FOR CARRYING GOLF ACCESSORIES

(76) Inventor: Young-Wook Kwon, 612-404 Kachimaeul Kunyoung Villa, 13 Kumi-Dong, Pundang-Gu, Seongnam-City, Kyungki-Do (KR)

( * ) Notice: Subject to any disclaimer, the term of this patent is extended or adjusted under 35 U.S.C. 154(b) by 0 days.

(21) Appl. No.: 09/461,725

(22) Filed: Dec. 16, 1999

(30) Foreign Application Priority Data

Nov. 29, 1999 (KR) ..... 99-53546

(51) Int. Cl.[7] ..... A45F 5/00

(52) U.S. Cl. ..... 224/269; 224/249; 224/251; 224/667; 224/684; 224/903; 224/918

(58) Field of Search ..... 224/918, 919, 224/666, 667, 684, 249, 251, 269, 903

(56) References Cited

U.S. PATENT DOCUMENTS

| | | | | |
|---|---|---|---|---|
| 1,383,968 | * | 7/1921 | Perry, Jr. et al. | 224/903 X |
| 2,182,194 | * | 12/1939 | Blau | 224/903 X |
| 3,233,802 | * | 2/1966 | Ludwick | 224/918 X |
| 3,819,095 | * | 6/1974 | Synder | 224/918 X |
| 3,905,525 | * | 9/1975 | Kawamata | 224/918 X |
| 4,151,937 | * | 5/1979 | Jarosh et al. | 224/918 X |
| 4,358,036 | * | 11/1982 | Maltais | 224/667 |
| 4,699,303 | * | 10/1987 | Kline | 224/918 X |
| 4,730,728 | * | 3/1988 | Larkin | 224/918 X |
| 4,736,877 | * | 4/1988 | Clark | 224/918 X |
| 4,850,483 | * | 7/1989 | Stack | 224/919 X |
| 4,875,579 | * | 10/1989 | Tak | 224/918 X |
| 5,054,777 | * | 10/1991 | Borden et al. | 224/918 X |
| 5,102,023 | * | 4/1992 | Nguyen | 224/903 X |
| 5,295,683 | * | 3/1994 | Tate | 224/918 X |
| 5,423,530 | * | 6/1995 | Alverez Gonzalez | 224/918 X |
| 5,441,185 | * | 8/1995 | Dragos | 224/666 |
| 5,489,051 | * | 2/1996 | Robinson | 224/249 X |
| 5,795,248 | * | 8/1998 | Giglio | 224/918 X |
| 5,799,853 | * | 9/1998 | Brewster | 224/918 X |
| 5,934,530 | * | 8/1999 | Antczak et al. | 224/918 X |

* cited by examiner

*Primary Examiner*—Gregory M. Vidovich
(74) *Attorney, Agent, or Firm*—Smith Patent Office

(57) ABSTRACT

A belt-mounted apparatus for carrying golf accessories, such as tees and ball markers, is disclosed. The apparatus consists of a belt saddle-clip, with a plurality of tee holders and ball marker holders being provided on the outside surface of the belt saddle-clip. In the above apparatus, a watch is preferably provided on the saddle-clip. In the belt saddle-clip, front and rear walls are integrated into a single structure at the top while defining a belt channel between the two walls. A plurality of embossments may be formed on the inside surface of the rear wall. The above holders and the watch are provided on the front wall of the belt saddle-clip, while the rear wall of the saddle-clip is preferably bent toward the front wall, thus forming an elastic lower flange gripping the belt when the saddle-clip is clipped on the belt. This apparatus allows a golfer to easily and effectively carry such small golf accessories in addition to a watch on his belt while golfing, thus being very convenient to the golfer.

10 Claims, 7 Drawing Sheets

BELT-MOUNTED APPARATUS FOR CARRYING GOLF ACCESSORIES

BACKGROUND OF THE INVENTION

1. Field of the Invention

The present invention relates to a belt-mounted apparatus for carrying golf accessories, such as ball markers, tees, etc., while golfing on a golf course.

2. Description of the Prior Art

While golfing, a tee, or a small wooden, plastic, metal, or rubber peg, is used for holding a golf ball thereon on a teeing ground and allowing a golfer to drive the ball when teeing off, while a ball marker is used for marking or indicating the on-green position of a ball on a putting green when the ball is picked up by a golfer as desired.

Golfers on a golf course have to carry such tees and ball markers so as to selectively use them while teeing off or putting. Such tees and ball markers are typically kept in pockets of golfers' clothing.

It is also necessary for golfers to keep track of time while golfing. However, wearing a watch on the wrist regrettably prevents a smooth swinging motion of a golfer, and so most golfers typically keep their watches in their pockets while golfing.

Such tees, ball markers, watches and the other small golf accessories carried by golfers have to be repeatedly used while golfing, and so it is necessary for the golfers to repeatedly remove such items from their pockets. This finally makes the pockets of golfers easily become dirty.

The tees, ball markers, watches and the other small golf accessories kept in the clothing pockets also undesirably cause discomfort to the golfers, thus being inconvenient to the golfers while walking on a golf course.

SUMMARY OF THE INVENTION

Accordingly, the present invention has been made keeping in mind the above problems occurring in the prior art, and an object of the present invention is to provide a belt-mounted apparatus for carrying golf accessories, which is designed to allow a golfer to easily and effectively carry the small golf accessories, such as tees and ball markers, on his belt while golfing.

Another object of the present invention is to provide a belt-mounted apparatus for carrying golf accessories, which is also designed to allow a golfer to easily and effectively carry a watch on his belt while golfing. In order to accomplish the above object, the present invention provides a belt-mounted apparatus for carrying golf accessories, comprising a belt saddle-clip, and a plurality of holders provided on the belt saddle-clip for holding the golf accessories on the saddle-clip.

In the above apparatus, the holders comprise a ball marker holder used for elastically holding the pin of a ball marker, and a tee holder used for holding a tee.

A watch may be provided on the belt saddle-clip. On the other hand, the belt saddle-clip comprises front and rear walls integrated into a single structure at the first ends thereof while defining a belt channel between the walls, and a plurality of embossments formed on the inside surface of the rear wall.

In the above apparatus, the golf accessory holders and the watch are provided on the front wall of the belt saddle-clip, while the rear wall of the belt saddle-clip is bent toward the front wall, thus forming an elastic lower flange gripping the belt when the saddle-clip is clipped on the belt.

In the present invention, the tee holders and the ball marker holders may be separately formed on the front wall of the saddle-clip. Alternatively, the two types of accessory holders may be integrated into a single structure wherein a ball marker holder is formed on the top surface of each tee holder projected on the front wall of the saddle-clip.

The watch is set on the front wall of the saddle-clip. That is, a circularly depressed seat, having a depth, is formed on the front wall of the saddle-clip, with the watch being hinged to the bottom of the edge of the seat at a hinged joint. The watch has a locking projection at a position of its edge opposite to the hinged joint and is detachably locked to a notched latch of the seat when the watch is fully closed and seated in the seat. The above watch has a dial on the inside surface, which faces the bottom of the seat when the watch is closed in the seat.

In the apparatus of this invention, the belt saddle-clip may be made of a flexible material or a hard material. When the saddle-clip is made of a hard material, it is necessary to gently curve the saddle-clip at a radius of curvature free from causing discomfort to a golfer.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
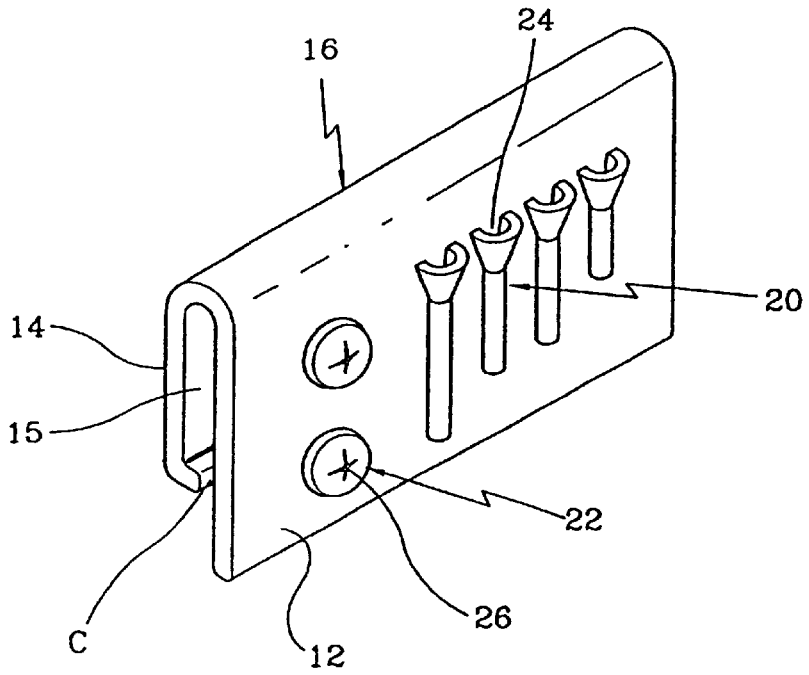
FIG. 1 is a perspective view of a golf accessory carrying apparatus in according with the primary embodiment of the present invention.

FIG. 1 is a perspective view of a golf accessory carrying apparatus according to the primary embodiment of this invention. As shown in the drawing, the apparatus of this embodiment comprises a belt saddle-clip 16, with front and rear walls 12 and 14 of the saddle-clip 16 being integrated into a single structure at a reversed U-shaped top while defining a belt channel 15 within the saddle-clip 16. The above belt saddle-clip 16 is exteriorly provided with a plurality of tee holders 20 and ball marker holders 22 on its front wall 12.

The belt saddle-clip 16 is made of an elastic material, such as plastic. The lower edge of the rear wall 14 is bent toward the front wall 12, thus forming a flange elastically gripping a belt when the saddle-clip 16 is clipped on the belt. The vertical width of the front wall 12 is larger than that of the rear wall 14.

The tee holders 20, having the same shape, are regularly and vertically formed on the front wall 12 while projecting from the wall 12. Each of the tee holders 20 forms an inner channel 24 having a funnel-shaped top inlet housing the tee head with a lengthwise narrow shank seat downwardly extending from the top inlet. The tee holders 20 thus stably hold the tees without allowing the tees to be undesirably moved within the channels 24 or to be removed from the channels 24.

On the other hand, the ball marker holders 22, having a circular shape, are formed on the front wall 12 at a position beside the tee holder area while being vertically arranged. Each of the circular-shaped ball marker holders 22 is projected from the front wall 12 to a height and has a cross-shaped slit 26 on its top surface, thus preventing the pin of a ball marker from damaging a belt passing through the channel 15 of the saddle-clip 16. In order to completely protect the belt from the pin of a ball marker, it is preferable to project each ball marker holder 22 to a height higher than the length of the pin of the ball marker. Of course, it should be understood that the ball marker holder area may be provided on the lower portion of the front wall 12 at a position free from the rear wall 14. In such a case, it is not necessary to project the ball marker holders 22 from the front wall 12.

In the golf accessory carrying apparatus of the primary embodiment, the saddle-clip 16 is clipped downwardly on the belt of a golfer from the gate C defined between the lower flange of the rear wall 14 and the interior surface of the front wall 12. In such a case, since the saddle-clip 16 is made of an elastic material, it is possible to easily clip the saddle-clip 16 on the belt even when the rear wall 14 is elastically brought into contact with the interior surface of the front wall 12 without leaving such a gate C.

When the apparatus of this embodiment is practically used by a golfer while golfing, a plurality of tees are respectively set within the tee holders 20 having the channels 24. In addition, a plurality of ball markers are set on the ball marker holders 22, with the pin of each ball marker being fitted into the center of the cross-shaped slit 26. The ball marker holders 22 thus elastically and stably hold the ball markers.

Figure 2:
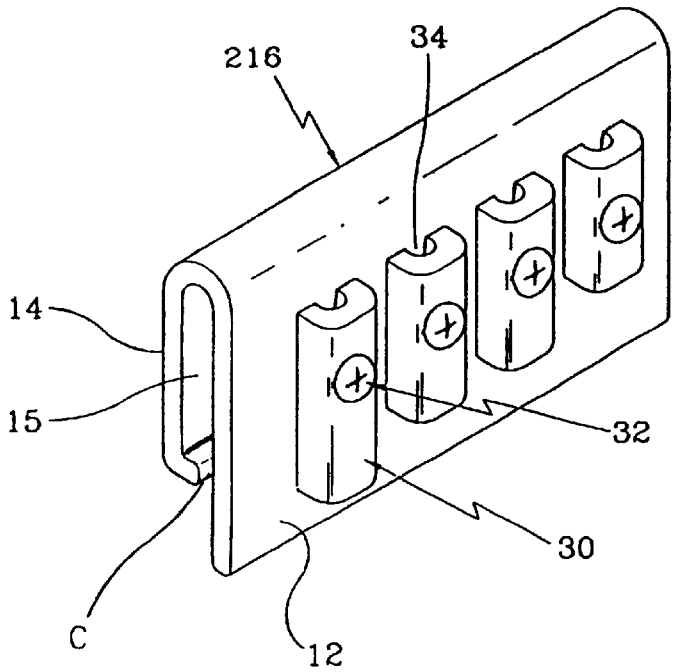
FIG. 2 is a perspective view of a golf accessory carrying apparatus in accordance with the second embodiment of the present invention.

FIG. 2 is a perspective view of a golf accessory carrying apparatus according to the second embodiment of this invention. As shown in the drawing, the apparatus of this embodiment comprises a belt saddle-clip 216 having the same shape as that described for the primary embodiment. In the second embodiment, a plurality of tee holders 30 are regularly and vertically formed on the front wall 12 of the saddle-clip 216, with a ball marker holder 32 being formed on the top surface of each tee holder 30 different from the primary embodiment. Each of the tee holders 30 of this embodiment has a tunnel shape, with the outer lower portion of each tee holder 30 housing the shank portion of a tee being designed to be wider than that of the primary embodiment. However, the inner channel 34 within each tee holder 30 has the same size as that of the channel 24 of the primary embodiment.

Since the ball marker holders 32 are formed on the top surfaces of the projected tee holders 30, the pins of the ball markers are prevented from extending through the saddle-clip and damaging the surface of the golfer's belt. When the apparatus of this embodiment is practically used by a golfer while golfing, a plurality of tees and ball markers are preferably and alternately set on the associated holders 30 and 32. That is, it is preferable to avoid the setting of a ball marker in a ball marker holder 32 formed on a tee holder 30 carrying a tee.

Figure 3:
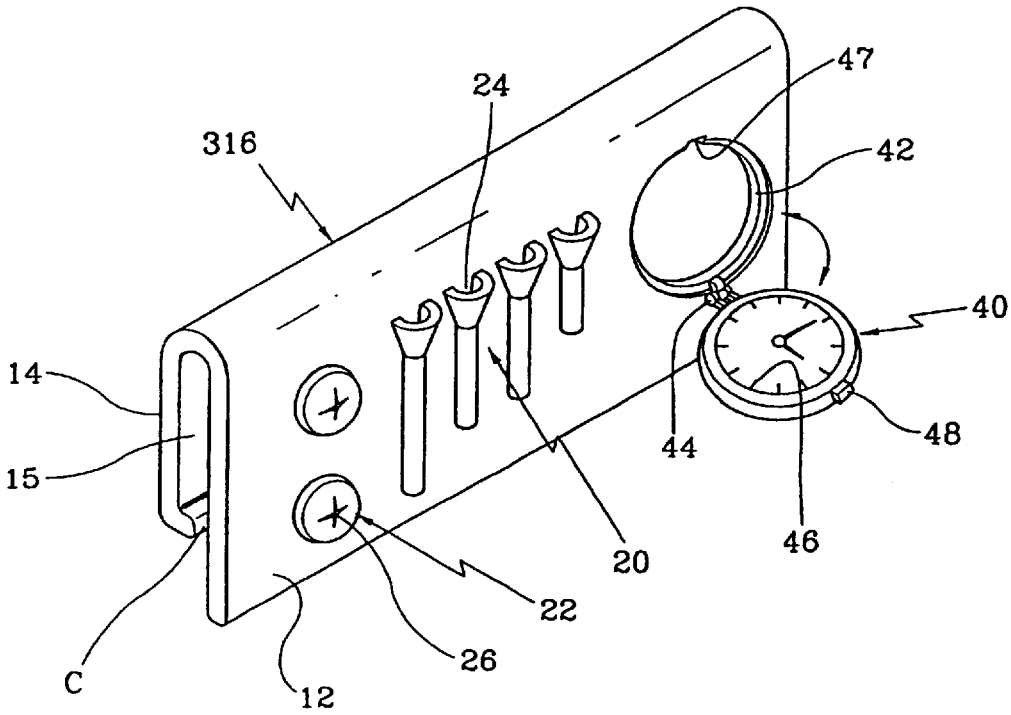
FIG. 3 is a perspective view of a golf accessory carrying apparatus in according with the third embodiment of the present invention.

FIG. 3 is a perspective view of a golf accessory carrying apparatus according to the third embodiment of this invention. In this embodiment, the general shape of the apparatus remains the same as that described for the primary embodiment, but a watch 40 is set on the front wall 12 of the saddle-clip 316 different from the primary embodiment.

That is, a circularly depressed seat 42, having a depth, is formed on the front wall 12 of the saddle-clip 316, with the watch 40 being hinged to the bottom of the edge of the seat 42 at a hinged joint 44. The watch 40 has a locking projection 48 at a position of its edge opposite to the hinged joint 44 and is detachably locked to a notched latch 47 of the seat 42 when the watch 40 is fully closed and seated in the seat 42. The above watch 40 has a dial 46 on the inside surface, which faces the bottom of the seat 42 when the watch 40 is closed in the seat 42.

The apparatus of the third embodiment allows a golfer to effectively carry a watch on his belt without holding it on his wrist or within his pocket. This finally allows the golfer to accomplish a desired smooth swinging motion while golfing without being disturbed by wearing the watch. In addition, the watch 40 is opened downwardly around the hinged joint 44 provided at the bottom of the edge of the seat 42, with the dial 46 being directed upwardly. Therefore, the golfer can easily view the dial 46 after opening the watch 40.

Of course, it should be understood that the watch 40 may be integrated with the front wall 12, with the dial 46 being formed on the surface leveled with the front wall 12. In such a case, it is preferable to invertedly position the watch with the mark "12" at the bottom of the edge of the dial 46, thus allowing a golfer to easily view at the dial 46.

Figure 4:
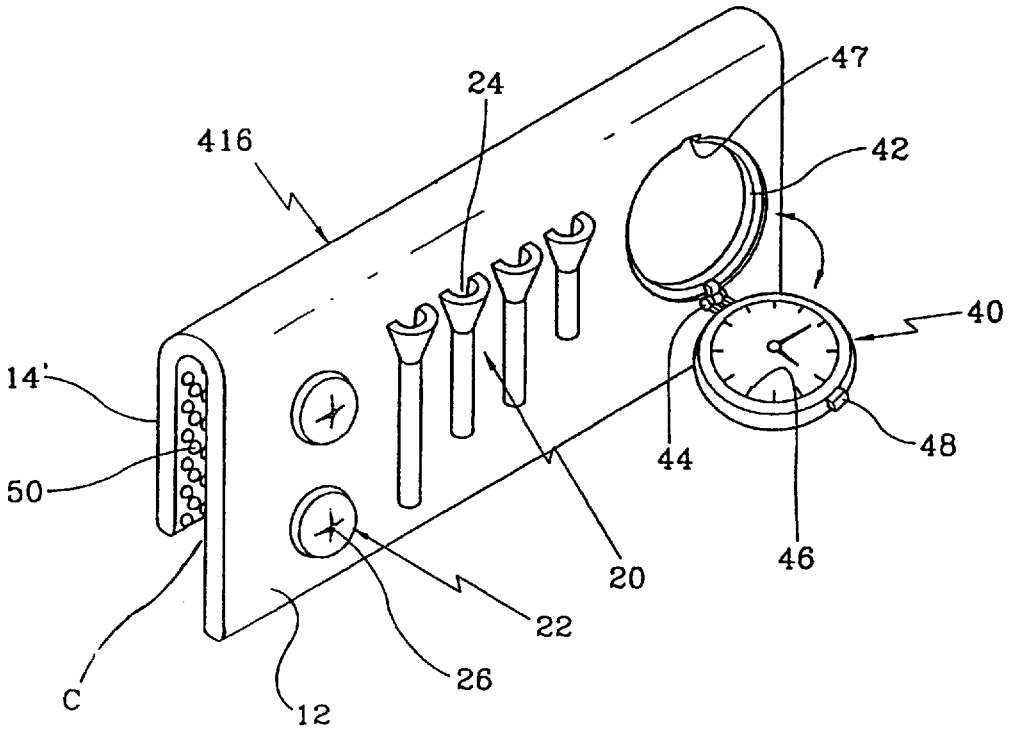
FIG. 4 is a perspective view of a golf accessory carrying apparatus in accordance with the fourth embodiment of the present invention.

FIG. 4 is a perspective view of a golf accessory carrying apparatus 416 according to the fourth embodiment of this invention. In this embodiment, the general shape of the apparatus remains the same as that described for the third embodiment, but the rear wall 14' is not bent at its lower edge with a plurality of embossments 50 being uniformly formed on the interior surface of the rear wall 14'. Due to the above embossments 50, the rear wall 14' tightly grips a belt in the same manner as that expected from the elastic lower flange of the rear wall. This apparatus yields the same operational effect as that expected from the apparatus of the third embodiment.

Figure 5:
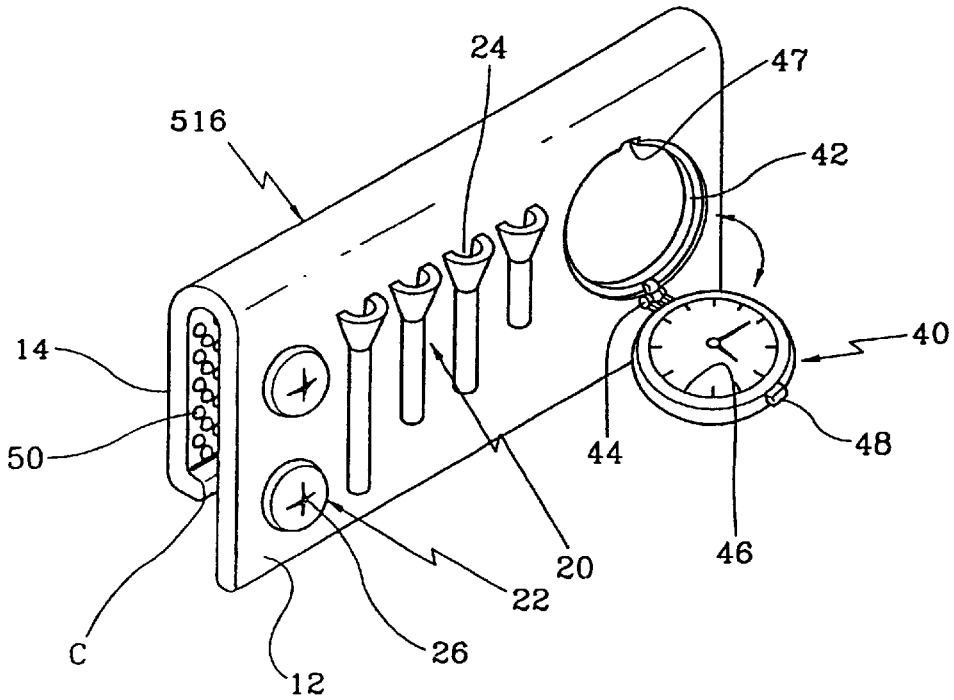
FIG. 5 is a perspective view of a golf accessory carrying apparatus in according with the fifth embodiment of the present invention.

FIG. 5 is a perspective view of a golf accessory carrying apparatus according to the fifth embodiment of this invention. In this embodiment, the general shape of the apparatus remains the same as that described for the third embodiment, but for a plurality of embossments 50 being uniformly formed on the interior surface of the rear wall 14. Due to the above embossments 50 in addition to the lower flange of the rear wall 14, the rear wall 14 further tightly grips a belt when the saddle-clip 516 is clipped on the belt.

Figure 6:
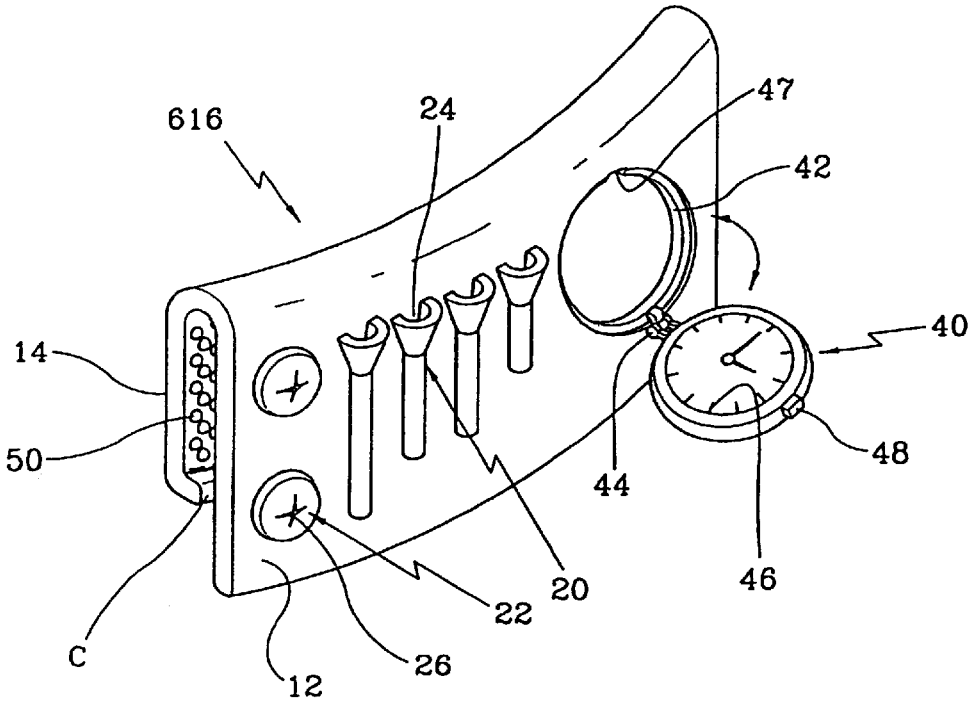
FIG. 6 is a perspective view of a golf accessory carrying apparatus in accordance with the sixth embodiment of the present invention.

FIG. 6 is a perspective view of a golf accessory carrying apparatus according to the sixth embodiment of this invention. In this embodiment, the general shape of the apparatus remains the same as that described for the fifth embodiment, but the belt saddle-clip 616 is made of a somewhat hard material and is smoothly curved at a radius of curvature so as to be free from pressurizing a golfer's waist or causing physical discomfort to a golfer's body.

Figure 7:
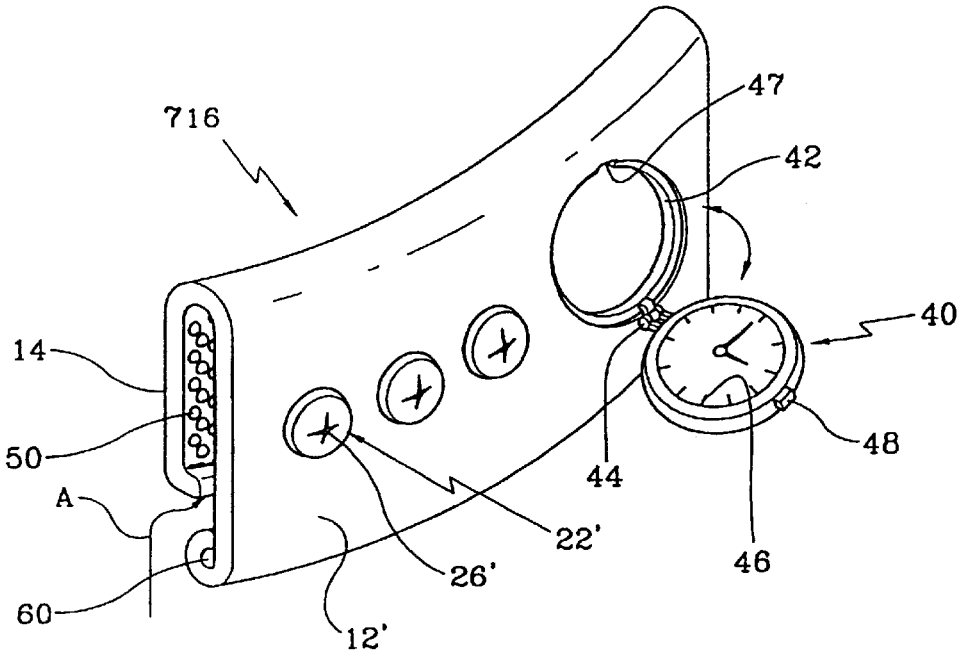
FIG. 7 is a perspective view of a golf accessory carrying apparatus in according with the seventh embodiment of the present invention.

FIG. 7 is a perspective view of a golf accessory carrying apparatus according to the seventh embodiment of this invention. In this embodiment, the general shape of the apparatus remains the same as that described for the sixth embodiment, but the tee holders 60 are formed along the inside of the lower edge of the front wall 12' of the belt saddle-clip 716 while being horizontally directed. In addition, the ball marker holders 22' are formed on the outside surface of the front wall 12' while forming a horizontal arrangement.

In the seventh embodiment, a tee locking means (not shown) is provided on the tee holders 60 for locking the tees set within the holders 60. However, it should be understood that the tee holders 60 may be designed to have elasticity while being slightly inclined at an angle of inclination with the inlets of the holders 60 positioned upwardly. In such a case, the tee holders 60 are preferably free from the separate tee locking means.

When the apparatus of the seventh embodiment is practically used, the apparatus is set on a belt by inserting the belt into the belt channel of the saddle-clip 716 as shown by the arrow A of FIG. 7. This apparatus yields the same operational effect as that expected from the apparatus of the sixth embodiment.

Figure 8:
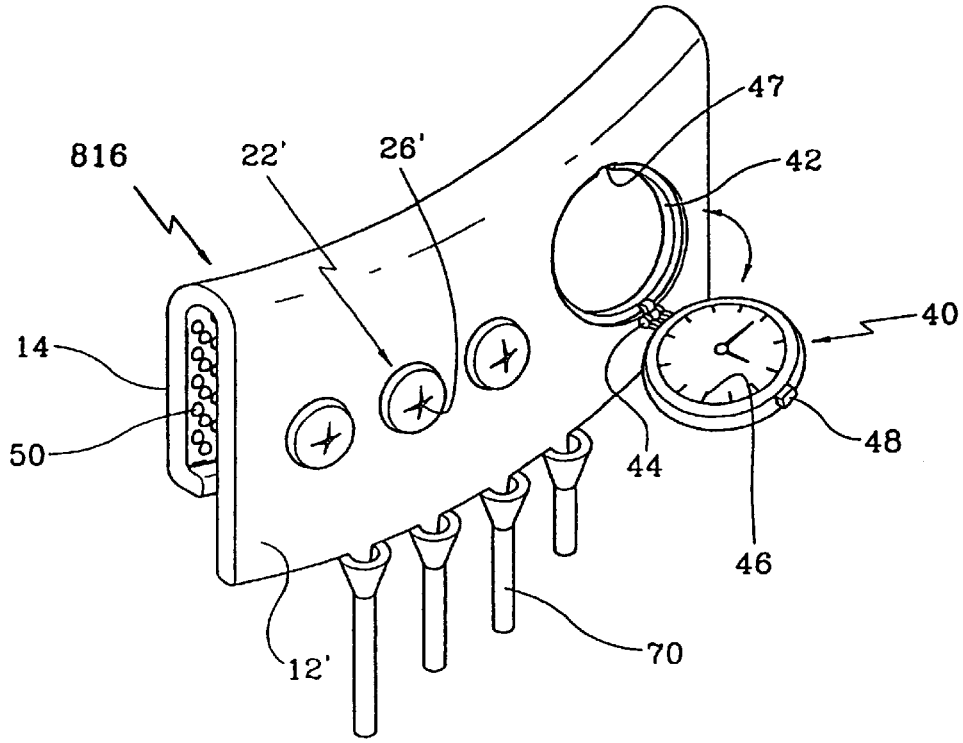
FIG. 8 is a perspective view of a golf accessory carrying apparatus in accordance with the eighth embodiment of the present invention.

FIG. 8 is a perspective view of a golf accessory carrying apparatus according to the eighth embodiment of this invention. In this embodiment, the general shape of the apparatus remains the same as that described for the seventh embodiment, but the tee holders 70 are vertically suspended along the lower edge of the front wall 12' of the belt saddle-clip 816.

Figure 9:
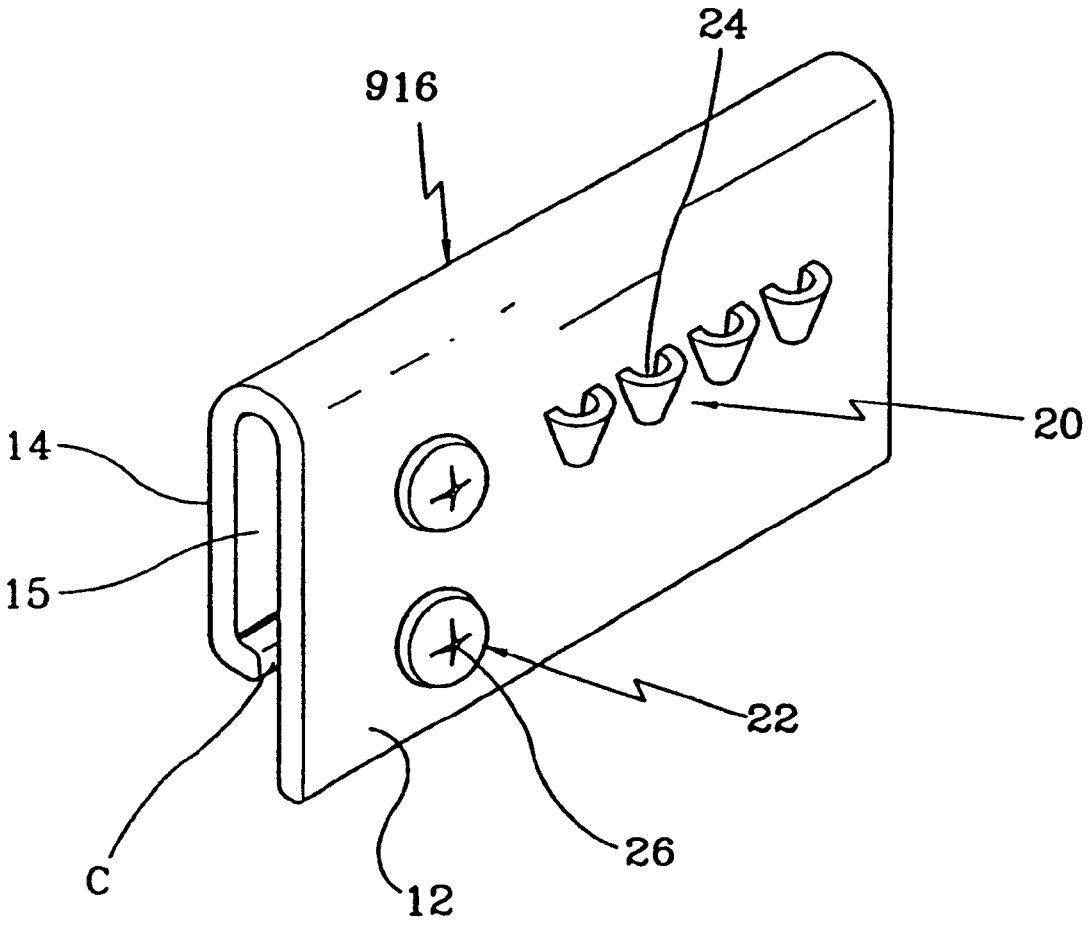
FIG. 9 is a perspective view of a golf accessory carrying apparatus in accordance with the ninth embodiment of the present invention.

FIG. 9 is a perspective view of a golf accessory carrying apparatus 916 according to the ninth embodiment of this invention. In this embodiment, the general shape of the apparatus 916 remains the same as that described for the primary embodiment, but the tee holders 20 are individually designed to have an inner channel 24 free from narrow shank seats. That is, the channels 24 of the tee holders 20 according to this embodiment are designed to hold the tee heads, with the shank portions of the tees being exposed outside from the bottom of the tee holders 20.

Figure 10:
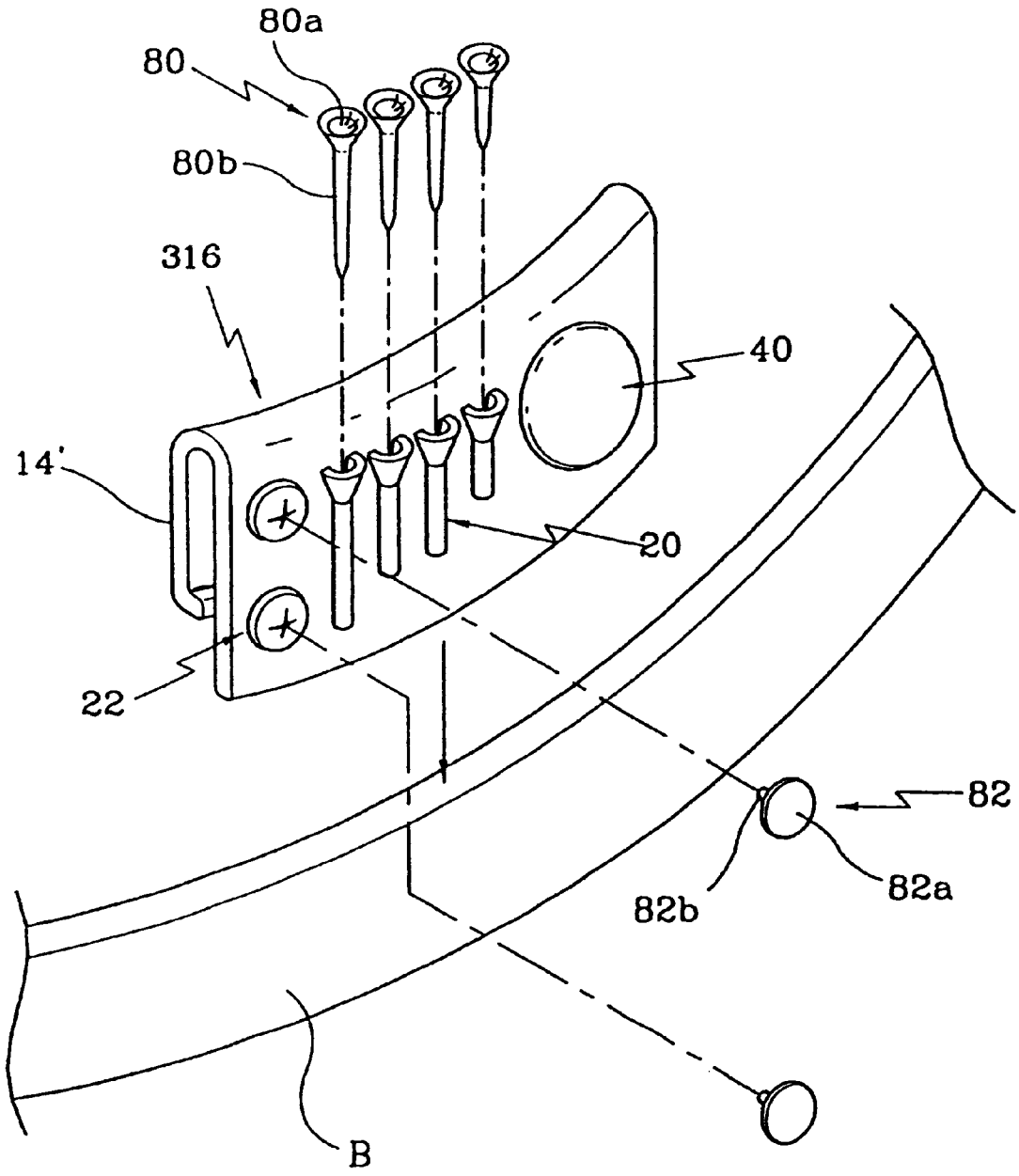
FIG. 10 is a view, showing the practical use of the apparatus of FIG. 6 with desired golf accessories, such as tees and ball markers, being aligned with associated holders.
Figure 11:
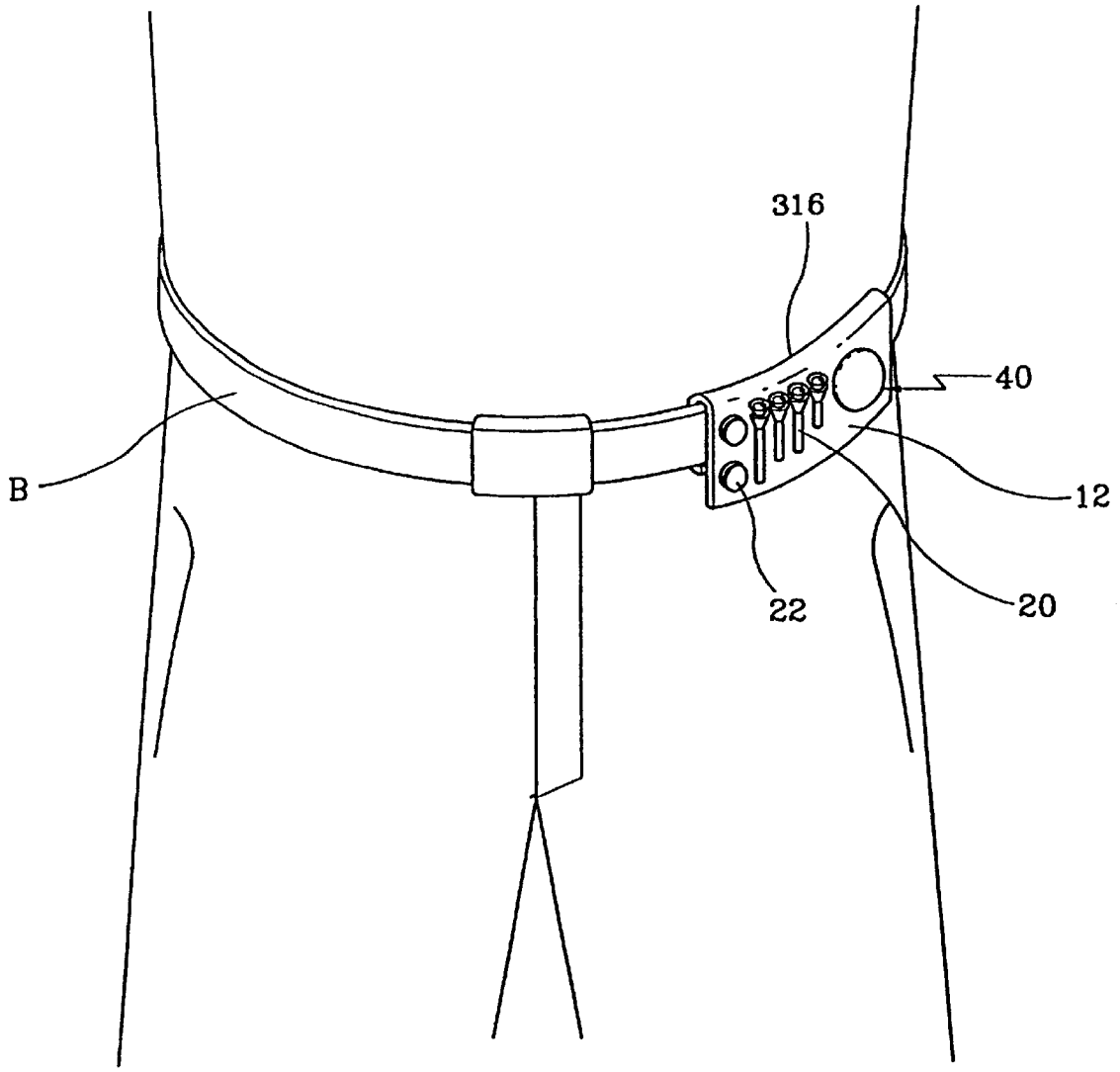
FIG. 11 is a view, showing the apparatus of FIG. 10 mounted on the belt of a golfer with the desired golf accessories being set in the associated holders.

FIG. 10 is a view, showing the practical use of the apparatus 316 of FIG. 6, with a belt B and desired tees 80 and ball markers 82 aligned with associated holders. FIG. 11 is a view, showing the apparatus of FIG. 10 mounted on the belt B, with the desired tees 80 and ball markers 82 set in the associated holders. As shown in the drawings, each of the tees 80 comprises a head 80*a* and a shank 80*b*, while each of the ball markers 82 comprises a head 82*a* and a pin 82*b*. In the drawings, the watch 40 is shown as fully closed in the seat 42.

As described above, the present invention provides a belt-mounted apparatus for carrying golf accessories, such as tees and ball markers, and a watch on the belt of a golfer. This apparatus allows the golfer to easily and effectively carry such small golf accessories and a watch on his belt while golfing, thus being very convenient to the golfer.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. For example, the number of tee holders and ball marker holders may be freely changed in accordance with the size of the area provided by the belt saddle-clip.

What is claimed is:

1. A belt-mounted apparatus for carrying golf accessories, comprising:

a belt saddle-clip, said belt saddle-clip further comprises front and rear walls integrated into a single structure at first ends thereof while defining a belt channel between the walls;

a plurality of holders provided on said belt saddle-clip for holding the golf accessories on the saddle-clip, said holders comprising a ball marker holder used for elastically holding a pin of a ball marker; and a tee holder used for holding a tee; and a watch attached to the front wall of said belt saddle-clip by a hinged joint, said hinged joint being located on a lower portion of said front wall, said watch having a watch face located on one side of said watch so that when said watch is disposed in a seat formed in the front wall, the watch face faces a bottom of said seat; and wherein said golf accessory holders and said watch are provided on the front wall of said belt saddle-clip.

2. The apparatus according to claim 1, wherein said belt saddle-clip comprises:

a plurality of embossments formed on an inside surface of said rear wall.

3. The apparatus according to claim 1, wherein said rear wall of the belt saddle-clip is bent toward the front wall, thus forming an elastic lower flange gripping the belt when the saddle-clip is clipped on the belt.

4. The apparatus according to claim 2, wherein said rear wall of the belt saddle-clip is bent toward the front wall, thus forming an elastic lower flange gripping the belt when the saddle-clip is clipped on the belt.

5. The apparatus according to claim 1, wherein said tee holder is located along an inside of a lower edge of the front wall.

6. The apparatus according to claim 1, wherein said tee holder is located on the front wall.

7. The apparatus according to claim 6, wherein said ball marker is located on a top surface of said tee holder.

8. The apparatus according to claim 1, wherein said apparatus is curved.

9. The apparatus according to claim 8, wherein said tee holder is located on the front wall.

10. The apparatus according to claim 8, wherein said tee holder is disposed along the lower portion of the front wall.

* * * * *